US005692674A

United States Patent [19]

Wicker

[11] Patent Number: 5,692,674

[45] Date of Patent: Dec. 2, 1997

[54] SELF-LOCKING SECURITY MAILBOX

[76] Inventor: Ronald L. Wicker, 620 County Line Rd., Harmony, N.C. 28634

[21] Appl. No.: 600,263

[22] Filed: Feb. 12, 1996

[51] Int. Cl.[6] ..... B65D 91/00

[52] U.S. Cl. ..... 232/17; 292/223

[58] Field of Search ..... 232/17, 41 A, 232/41 D; 292/219, 223

[56] References Cited

U.S. PATENT DOCUMENTS

| | | | |
|---|---|---|---|
| 2,245,855 | 6/1941 | Fletcher | 292/223 |
| 4,382,540 | 5/1983 | Kelly et al. | 232/17 |
| 4,726,512 | 2/1988 | White . | |
| 4,869,425 | 9/1989 | Chiou . | |
| 4,989,907 | 2/1991 | Edmonds et al. | 292/223 |
| 5,407,126 | 4/1995 | Coultas et al. . | |
| 5,476,220 | 12/1995 | Cohoon | 232/41 D X |

*Primary Examiner*—Jerry Redman
*Attorney, Agent, or Firm*—Donald A. Kettlestrings

[57] ABSTRACT

A self-locking receptacle, such as a rural mailbox, includes a housing having an open end and a closure movably mounted on the housing for closing and opening the end. A latching member is fixedly and immovably attached to and is located within the housing adjacent to the open end. A locking assembly is attached to the closure for contacting and selectively interlocking with the latching member when the closure is closed for enabling the closure to be opened and then closed only once without requiring unlocking and disengaging of the locking assembly from interlocking relationship with the latching member.

18 Claims, 6 Drawing Sheets

SELF-LOCKING SECURITY MAILBOX

BACKGROUND OF THE INVENTION

This invention relates to self-locking receptacles and more particularly to a self-locking security mailbox.

Theft of mail from rural mailboxes is a frustrating and growing problem, and various solutions to this problem have been proposed. Although existing devices and mechanisms designed to solve this problem have served the purpose, they have not proved entirely satisfactory. For example, some of the existing devices and mechanisms are relatively complex and cannot be manufactured economically. Some do not comply with U.S. postal regulations. Other existing devices include movable and cumbersome mechanisms mounted within the interior of the mailbox housing which can interfere with the insertion and removal of mail from the box.

It is, therefore, an object of the present invention to provide a self-locking receptacle.

Another object is to provide a self-locking security mailbox.

A further object of the invention is the provision of a self-locking mailbox having a door which can be opened and then closed only once without requiring unlocking of a locking assembly.

Still another object is to provide a self-locking mailbox which is of simple design and which uses a minimum number of parts while providing for reliable operation.

A still further object is to provide a self-locking mailbox which includes an interior which is free of any movable protrusions so that mail can be inserted into and withdrawn from the mailbox without interference.

Another object is to provide a self-locking mailbox which is relatively inexpensive to manufacture.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides a self-locking receptacle comprising: a housing defining an interior and an open end; a closure defining inner and outer surfaces and movably mounted on the housing for closing and opening the open end; a latching member fixedly and immovably attached to and located within the housing adjacent to the open end; and locking means attached to the closure for contacting and selectively interlocking with the latching member when the closure is closed for enabling the closure to be opened and then closed only once without requiring unlocking and disengaging of the locking means from interlocking relationship with the latching member.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
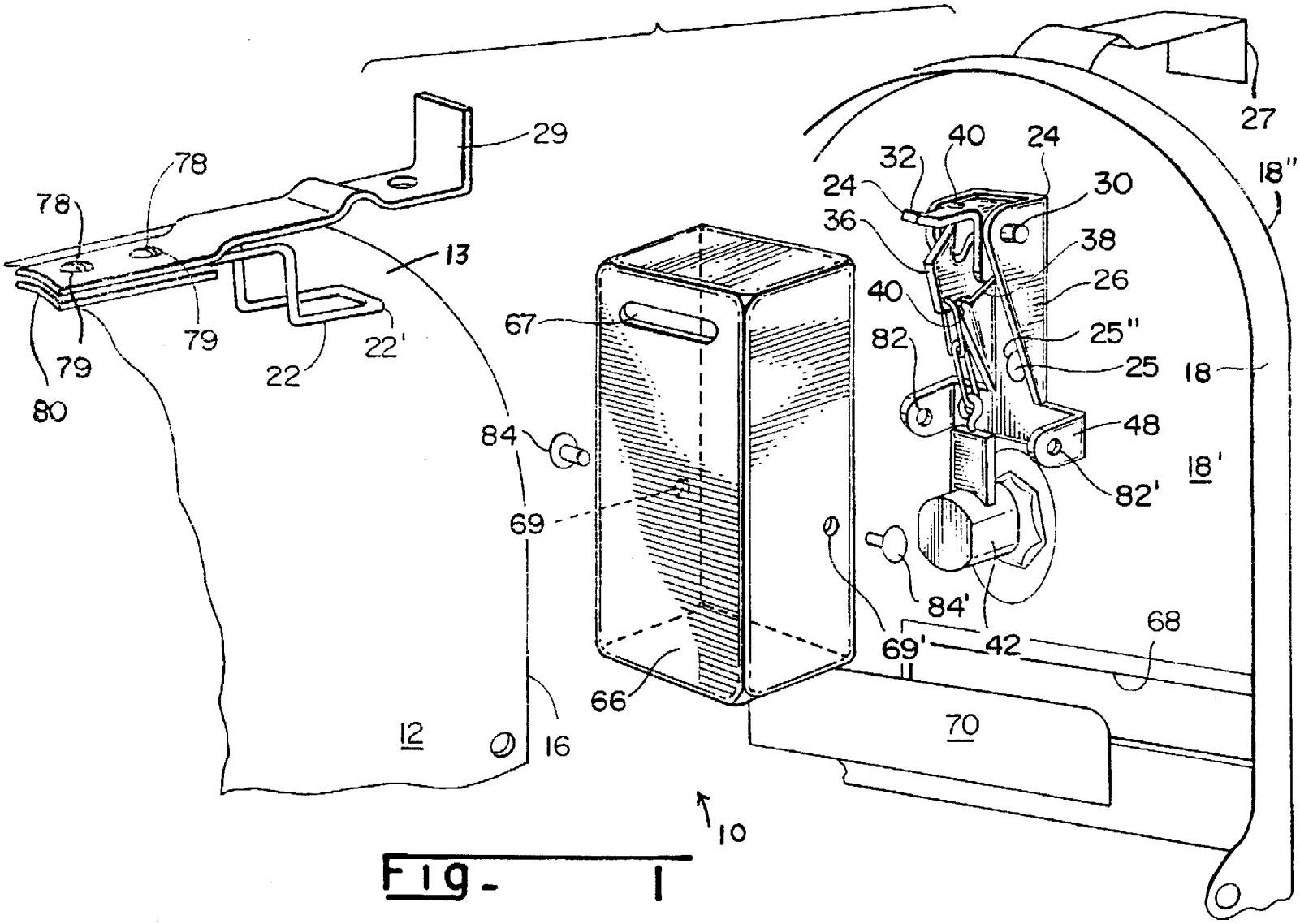
FIG. 1 is a fragmentary, exploded perspective view of the self-locking security mailbox.
Figure 2:
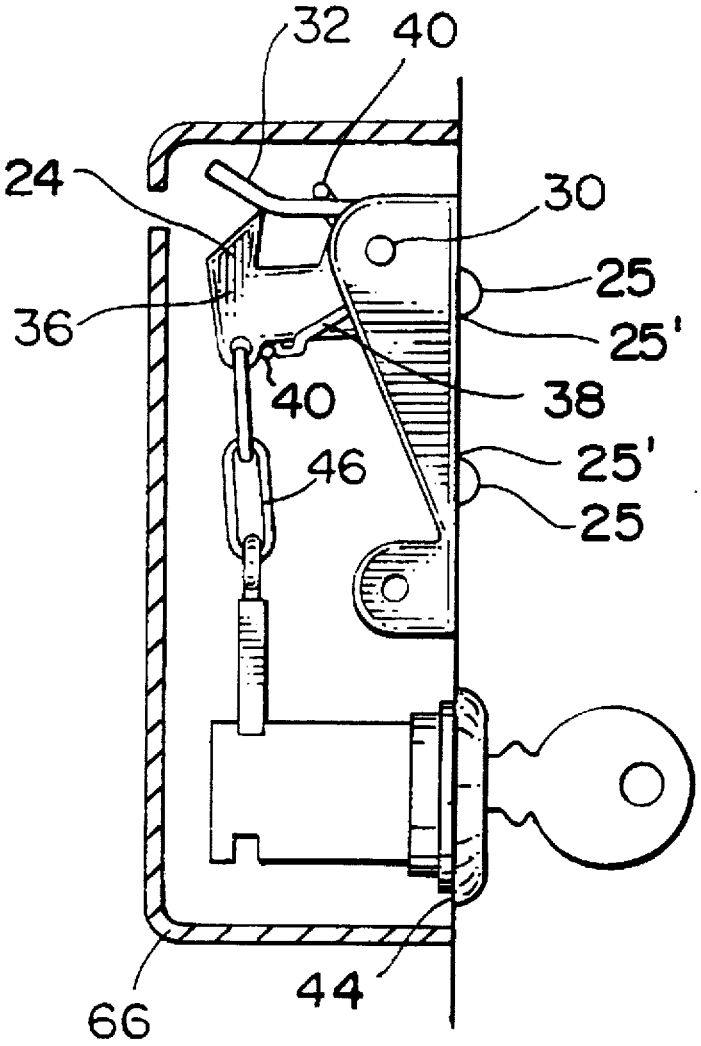
FIG. 2 is a fragmentary cross-sectional view showing a portion of the self-locking mechanism.
Figure 3:
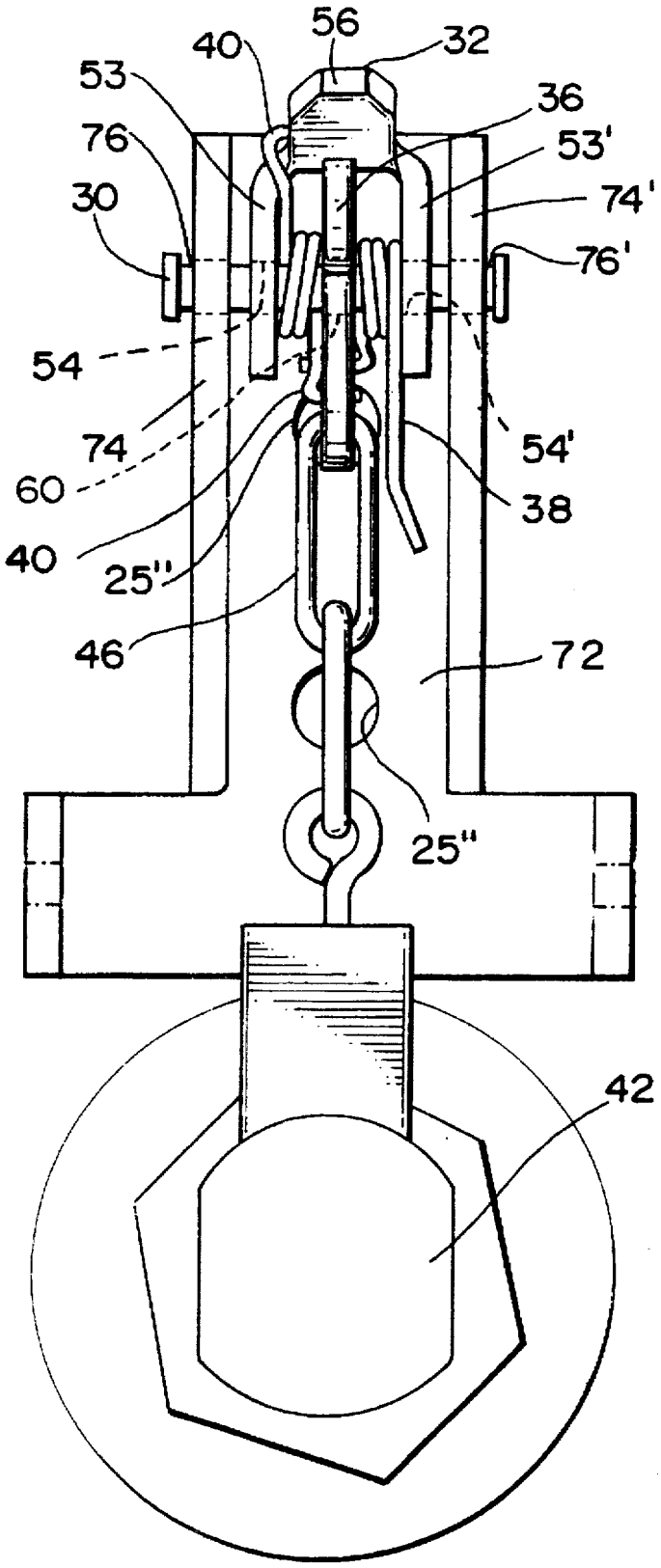
FIG. 3 is a front elevation view of a portion of the self-locking mechanism.
Figure 4:
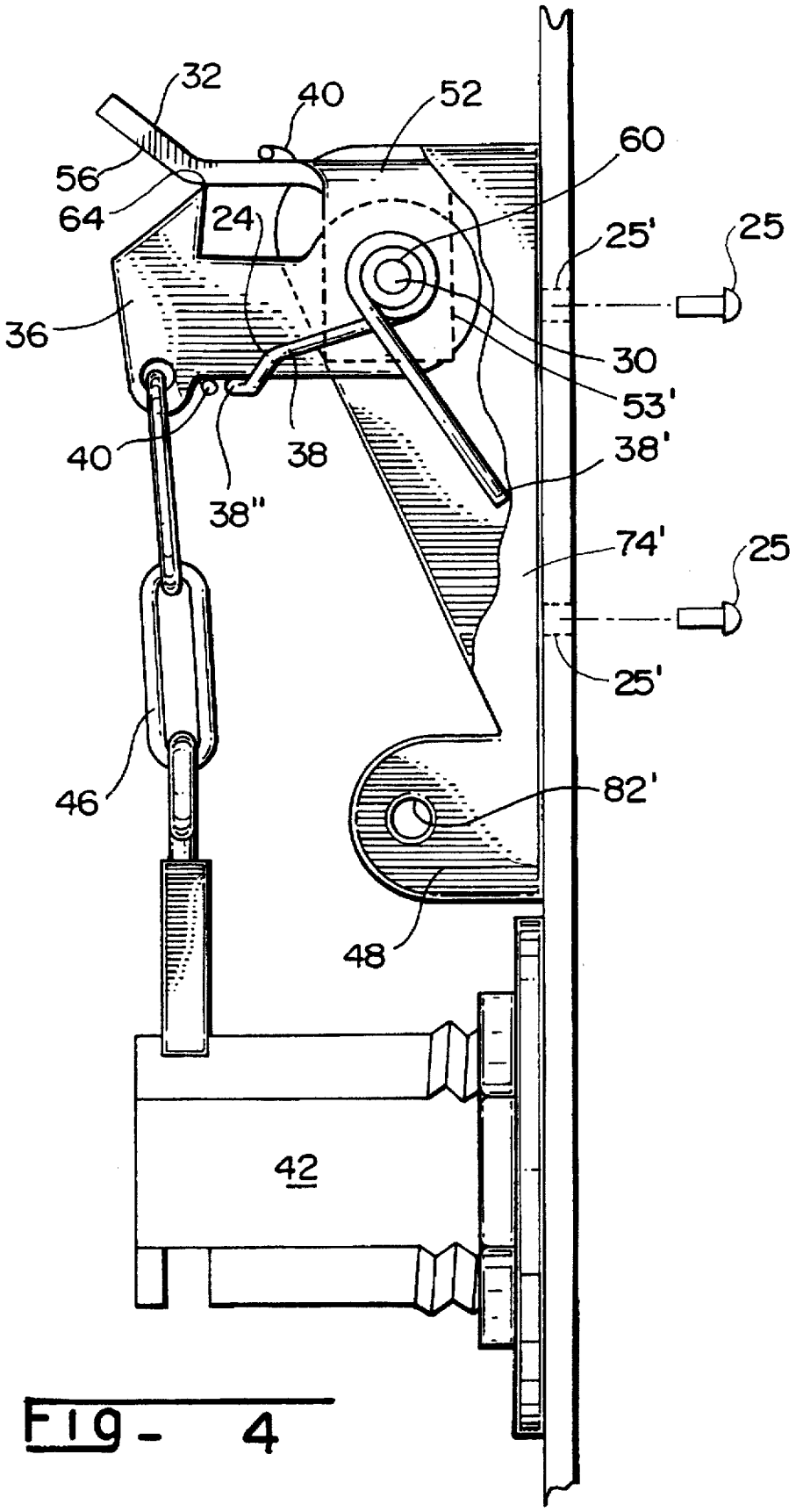
FIG. 4 is a fragmentary right side elevation view of a portion of the self-locking mechanism.
Figure 5:
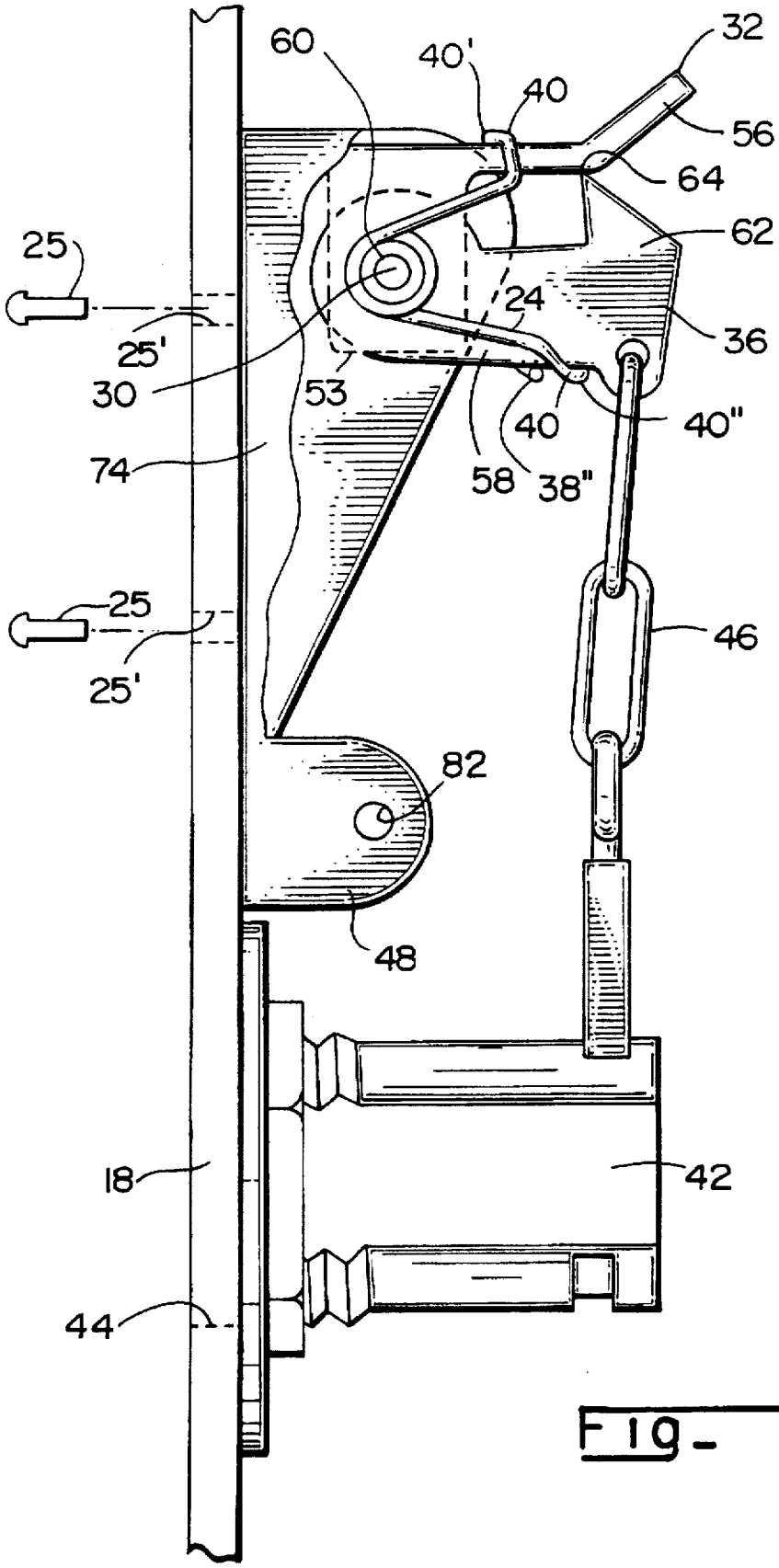
FIG. 5 is a fragmentary left side elevation view of a portion of the self-locking mechanism.

With reference now to the drawings, wherein like reference characters designate like or corresponding parts throughout the several views, there is shown a self-locking receptacle 10, such as a rural mailbox, which includes a housing 12 defining an interior 14 and an open end 16. A closure or door 18, defining inner and outer surfaces 18', 18", respectively, is conventionally movably mounted on housing 12 for closing and opening open end 16.

A latching member 22 is fixedly and immovably attached to and located within housing 12 adjacent to open end 16, and latching member 22 is positioned in close proximity to upper wall 13 of housing 12 so as not to interfere with insertion and removal of mail from the interior of housing 12. Locking means, generally indicated at 24 in FIG. 1, are attached to closure 18 for contacting and selectively interlocking with latching member 22 when closure 18 is closed for enabling closure 18 to be opened and then closed only once without requiring unlocking and disengaging of locking means 24 from interlocking relationship with latching member 22.

In accordance with the invention, locking means 24 include a base member 26 mounted on inner surface 18' of closure 18. Base member 26 is preferably mounted to closure or door 18 by using the same rivets 25 and openings 25' which connect conventional door half catch 27 to door 18. Base member 26 defines openings 25" which are aligned with openings 25' and which receive rivets 25 for mounting base member 26 to closure 18.

Base member 26 preferably includes a bracket element 48 which defines holes or openings 82, 82' therein. Base member 26 also includes a U-shaped channel element 72 in which openings 25" are defined and which further defines opposed side walls 74, 74'. A pin member 30 is attached to and extends between side walls 74, 74' through opposed openings 76, 76' within side walls 74, 74'.

Locking means 24 also include first means 32 rotatably mounted on pin member 30 for contacting portion 22' of latching member 22 when closure 18 is moved to close open end 16. Locking means 24 further include second means 36 rotatably mounted on pin member 30 and normally located beneath first means 32 for selectively contacting first means 32 as first and second means 32, 36 are rotated about pin member 30 and for selectively engaging portion 22' of latching member 22 in interlocking relationship when closure 18 is moved to close open end 16.

Locking means 24 also include first spring 38 positioned with respect to first means 32 and second means 36 for contacting second means 36 and for urging first and second means 32, 36 upwardly in first direction 34 about pin member 30. Locking means 24 further include a second spring 40 positioned with respect to first and second means 32, 36 for contacting first and second means 32, 36 and for urging first and second means 32, 36 toward each other about pin member 30.

Springs 38, 40 are each mounted on pin member 30. Spring 38 defines a first end 38' in contacting relationship with base 26 and a second end 38" in contacting relationship with second means 36. Spring 40 defines a first end portion 40' in contacting relationship with first means 32 and a second end portion 40" in contacting relationship with second means 36 so that spring 40 acts to urge first and second means 32, 36 together about pin member 30.

Locking means 24 further include a lock 42 attached to closure 18 in a conventional manner through opening 44 in closure 18. Locking means 24 also include connecting means 46 connected between lock 42 and second means 36 for downwardly rotating second means 36 in second direction 34' about pin member 30 in response to lock 42 being placed in an unlocked condition. Although lock 42 is illustrated as a lock requiring use of a key, it should be understood that other conventional locks could be used, such as a combination lock or a magnetic latch, for example. Connecting means 46 is flexible and may be comprised of interlocking chain links or a flexible cord.

In accordance with the invention, first means 32 includes an inverted U-shaped element 52 rotatably mounted on pin member 30 by means of openings 54, 54', and a tine element 56 projects from U-shaped element 52. Second means 36 includes a body element 58 rotatably mounted on pin member 30 by means of opening 60, and a head element 62, defining a pointed portion 64 for engaging latching member 22, is connected to body element 58. Body element 58 is positioned between side walls 53, 53' of U-shaped element 52 and beneath tine element 56.

A cover 66 defines an elongated opening or slot 67 therein, and first and second holes 69, 69' are also defined within cover 66. Third and fourth holes 82, 82' are defined within bracket element 48 of base member 26, and fastening elements 84, 84' extend through holes 69, 82 and through holes 69', 82', respectively, for attaching cover 66 to base member 26. Elongated opening 67 in cover 66 enables portion 22' of latching member 22 to be received through opening 67.

Springs 38, 40 are positioned between side walls 53, 53' of U-shaped element 52 in first means 32, and second means 36 is positioned between side walls 53, 53' and between springs 38, 40.

Receptacle 10 may be a rural type mailbox, and closure or door 18 preferably defines a mail slot 68 therein for receiving mail therethrough. A spring-biased cover 70 is conventionally positioned on inner surface 18' of door 18 to normally cover and protect mail slot 68 while permitting mail to be inserted into the mailbox through mail slot 68.

Figures 6A, 6B, 6C, 6D, 6E, 6F, 6G:
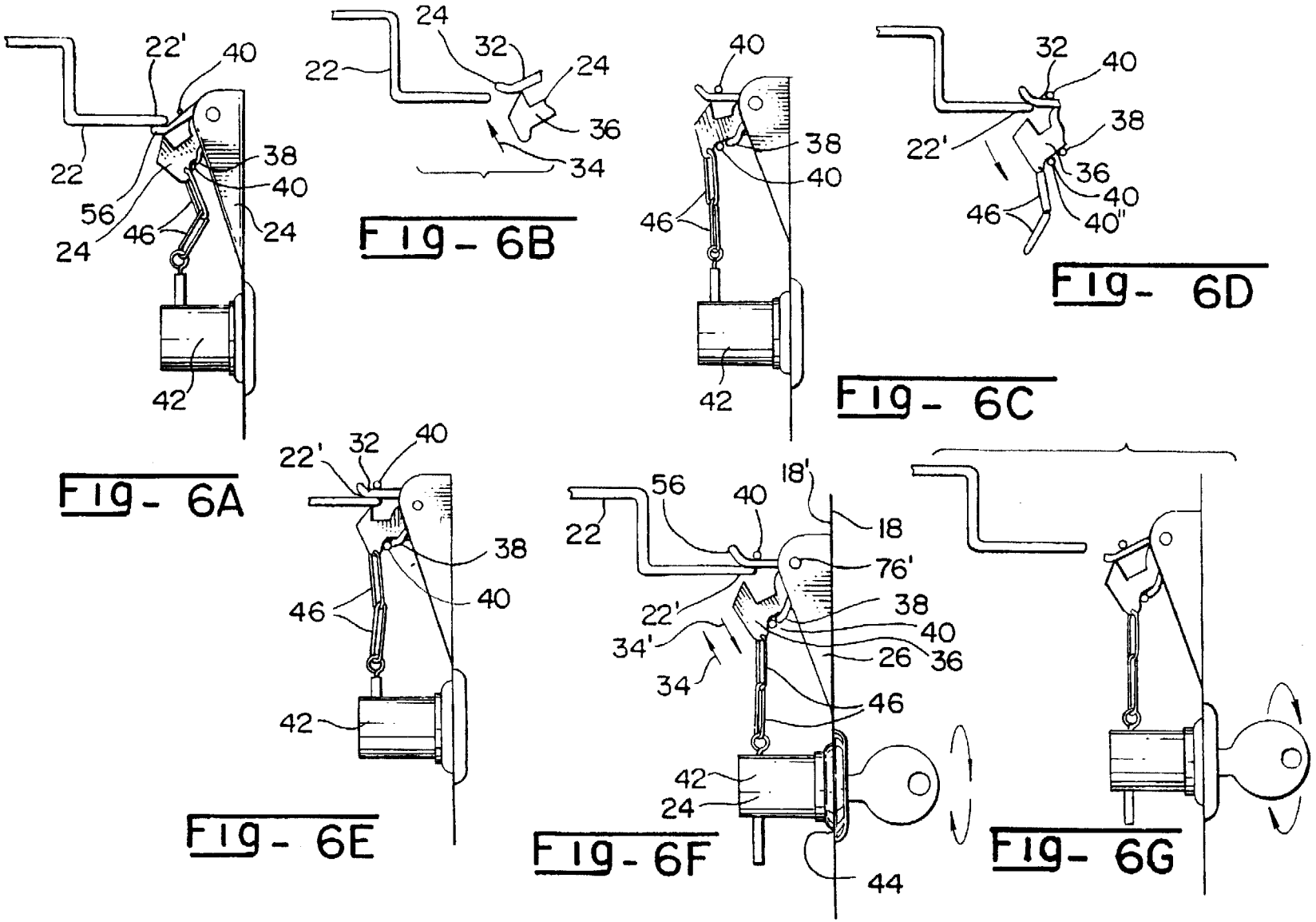
FIGS. 6A–6G are each fragmentary right side elevation views of a portion of the self-locking mechanism showing the sequence of operation of the self-locking security mailbox.

The operating sequence of locking means 24 is illustrated in FIGS. 6A–6G starting with the set position shown in FIG. 6A. In the set position, closure or door 18 is closed with respect to open end 16, and tine element 56 is located beneath and in contact with portion 22' of latching member 22. Tine element 56 is forced upwardly against latching member portion 22' by the force from spring 38.

When the mail carrier, for example, opens door 18 for insertion of mail into housing 12, latching member 22 is separated from locking means 24 which permits first and second means 32, 36 to move upwardly in direction 34 as a result of the forces generated by spring 38. This step in the operating sequence is illustrated in FIG. 6B. First and second means 32, 36 continue to move upwardly in direction 34 because of the force generated by spring 38 to the ready position illustrated in FIG. 6C.

When the mail carrier then closes door 18, locking means 24 engage latching member portion 22' as shown in FIG. 6D. Specifically, latching member portion 22' moves between and separates first and second means 32, 36 which are urged together by spring 40.

When door 18 is completely shut, second means 36 snaps into locking and engaging relationship with latching member 22 because of the forces created by springs 38 and 40. Pointed portion 64 of second means 36 snaps into position behind portion 22' of latching member 22 thereby locking door 18 in closed position with respect to end 16. This locked position is shown in FIG. 6E.

When the postal patron, for example, wishes to retrieve mail from receptacle 10, the patron unlocks lock 42 by use of a key or otherwise. This unlocking action, through connecting means 46, rotates second means 36 downwardly in direction 34', as shown in FIG. 6F. This removes pointed portion 64 of second means 36 from locking engagement with latch member 22, and locking means 24 is in the unlocked position. Upon opening of door 18 by the postal patron, tine element 56 snaps downwardly in direction 34' because of the action of spring 40 until tine element 56 contacts pointed portion 64 of second means 36. This is shown in FIG. 6G.

After retrieving mail from receptacle 10, the postal patron closes door 18. The postal patron then has two options. One option is to turn the key for lock 42 or to otherwise place lock 42 in its locked position. This then places locking mechanism 24 into the set position shown in FIG. 6A and ready for the next mail delivery. The second option for the postal patron is to remove the key from lock 42 or otherwise maintain lock 42 in its unlocked position. This will cause tine element 56 and second means 36 to remain in the positions shown in FIG. 6G to allow door 18 to open and close freely and to bypass locking means 24.

Pin member 30 may be a rivet, for example, and pin member 30 serves as the operating axis for first and second means 32, 36 and for springs 38, 40.

Latching member 22 can be attached to upper wall 13 of housing 12 by using the same rivets or other fasteners 78 which are conventionally used to connect half catch 29 to housing 12. Openings 79 within housing 12 are conventionally provided for receiving rivets 78, and a washer element 80 can be used in cooperation with rivets 78 to hold latching member 22 in fixed and immovable position.

This invention provides a self-locking security receptacle which uses a minimum number of parts and which is reliable in operation. The locking assembly enables the postal patron, if the receptacle is a mailbox, to place the locking assembly and the receptacle in a set position allowing the mail carrier to open the closure. The mail carrier then closes the closure or door of the receptacle and the locking assembly then locks the door in a locked and closed position. Thereafter, the door can only be unlocked by the postal patron or owner of the receptacle with a key or other means of unlocking the lock. The owner or postal patron can then reset the locking assembly and the door for the next mail delivery where again the mail carrier can open and shut the door only once.

The invention in its broader aspects is not limited to the specific details shown and described, and departures may be made from such details without departing from the principles of the invention and without sacrificing its chief advantages.

What is claimed is:

1. A self-locking receptacle, comprising:

a housing defining an interior and an open end;

a closure defining inner and outer surfaces and movably mounted on said housing for closing and opening said open end;

a latching member fixedly and immovably attached to and located within said housing adjacent to said open end; and locking means attached to said closure, said locking means contacting and selectively interlocking with said latching member when said closure is closed which enables said closure to be opened and then closed only once without requiring unlocking and disengaging of said locking means from interlocking relationship with said latching member.

2. A receptacle as in claim 1 wherein said locking means include:

a base member mounted on said inner surface of said closure;

a pin member attached to said base member;

first means rotatably mounted on said pin member for contacting said latching member when said closure is moved to close said open end; and second means rotatably mounted on said pin member and normally located beneath said first means for selectively contacting said first means as said first and second means are rotated about said pin member and for selectively engaging said latching member in interlocking relationship when said closure is moved to close said open end.

3. A receptacle as in claim 2 wherein said locking means further include:

first spring means in operative relationship with said first and second means, with said base member and with said pin member for urging said first and second means upwardly about said pin member.

4. A receptacle as in claim 3 wherein said locking means further include:

second spring means in operative relationship with said first and second means and with said pin member for urging said first and second means toward each other about said pin member.

5. A receptacle as in claim 4 wherein said locking means further include:

a lock attached to said closure; and connecting means connected between said lock and said second means for downwardly rotating said second means about said pin member in response to said lock being placed in an unlocked condition.

6. A receptacle as in claim 5 wherein said connecting means is flexible.

7. A receptacle as in claim 6 wherein said first and second spring means are each mounted on said pin member.

8. A receptacle as in claim 7 wherein said first means includes a substantially inverted U-shaped element rotatably mounted on said pin member, and a tine element projecting from said U-shaped element.

9. A receptacle as in claim 8 wherein said second means includes a body element rotatably mounted on said pin member and a head element defining a substantially pointed portion for engaging said latching member, said head element connected to said body element.

10. A receptacle as in claim 9 further including a first cover defining an elongated opening therein, and wherein said base member includes a bracket element, said cover attached to said bracket element and covering said locking means.

11. A receptacle as in claim 10 wherein said receptacle is a mailbox.

12. A receptacle as in claim 11 wherein said closure defines a mail slot therein for receiving mail therethrough.

13. A receptacle as in claim 9 wherein said base member further includes a substantially U-shaped channel element defining first and second opposed side walls, and wherein said pin member is attached to and extends between said side walls.

14. A receptacle as in claim 13 wherein said first spring means defines a first end in contacting relationship with said base and a second end in contacting relationship with said second means.

15. A receptacle as in claim 14 wherein said second spring means defines a first end portion in contacting relationship with said first means and a second end portion in contacting relationship with said second means, whereby said second spring means acts to urge said first and second means together about said pin member.

16. A receptacle as in claim 15 wherein said U-shaped element of said first means includes third and fourth side walls and wherein said first and second spring means are positioned on said pin member between said third and fourth side walls.

17. A receptacle as in claim 16 wherein said second means is positioned on said pin member between said third and fourth side walls.

18. A receptacle as in claim 17 wherein said second means is positioned between said first and second spring means.

* * * * *